US005916667A

United States Patent [19]

Castle

[11] Patent Number: 5,916,667

[45] **Date of Patent: *Jun. 29, 1999**

[54] INK JET IMAGING OF HEAVY INK COVERAGE PRINTED ARTICLES

[75] Inventor: William Jay Castle, Hilliard, Ohio

[73] Assignee: The Standard Register Company, Dayton, Ohio

[ * ] Notice: This patent issued on a continued prosecution application filed under 37 CFR 1.53(d), and is subject to the twenty year patent term provisions of 35 U.S.C. 154(a)(2).

[21] Appl. No.: 08/726,628

[22] Filed: Oct. 7, 1996

[51] Int. Cl.[6] ..... B05D 5/04; B41M 5/00

[52] U.S. Cl. ..... 428/195; 428/209; 428/210; 428/211; 428/212; 428/537.5

[58] Field of Search ..... 428/195, 212, 428/207–211, 537.5

[56] References Cited

U.S. PATENT DOCUMENTS

| | | |
|---|---|---|
| 2,597,863 | 5/1952 | Greubel . |
| 2,602,072 | 7/1952 | Greubel . |
| 4,024,096 | 5/1977 | Watchtel . |
| 4,045,397 | 8/1977 | Parkinson . |
| 4,155,767 | 5/1979 | Specht et al. . |
| 4,170,681 | 10/1979 | Edwards et al. . |
| 4,210,566 | 7/1980 | Murray . |
| 4,702,742 | 10/1987 | Iwata et al. . |
| 4,792,487 | 12/1988 | Schubring et al. . |
| 4,808,443 | 2/1989 | Minamoto et al. . |
| 5,022,947 | 6/1991 | Hasegawa et al. . |
| 5,035,946 | 7/1991 | Baker et al. . |
| 5,164,232 | 11/1992 | Henseleit et al. . |
| 5,270,368 | 12/1993 | Lent et al. . |
| 5,368,891 | 11/1994 | Sagara et al. . |
| 5,460,856 | 10/1995 | O'Lenick, Jr. . |
| 5,542,710 | 8/1996 | Silverschotz et al. ..... 283/94 |

*Primary Examiner*—Pamela R. Schwartz
*Attorney, Agent, or Firm*—Killworth, Gottman, Hagan & Schaeff, L.L.P.

[57] ABSTRACT

With proper control of the surface energy of the press ink and the surface tension of the ink jet ink, an article which has a press ink coverage of greater than 30% screen can be successfully imaged with ink jet ink to provide substantially uniform coverage of ink jet ink in the imaged areas. The ink jet ink to be imaged over the press ink must be low enough in surface tension to enable it to wet the surface of the printed article and to be retained on the surface of the article. The ink jet ink can be compatibilized with the press ink either by adjusting one or both of the surface tensions of the ink jet ink and the press ink and/or through the use of a compatibilizing liquid which provides a compatible interface between the ink jet ink and the press ink.

16 Claims, 1 Drawing Sheet

INK JET IMAGING OF HEAVY INK COVERAGE PRINTED ARTICLES

This invention relates to ink jet imaging and more particularly to a process for printing and imaging which enables successful ink jet imaging on areas of a printed article having a heavy coverage of press ink.

BACKGROUND OF THE INVENTION

For the last twenty years, many improvements have been made in the art of ink jet imaging. The quality of the imaging has improved, and the speed of that imaging has increased. The number of type fonts available has grown to over 200. The image density has increased to 240 dots per inch. The design of the equipment used to perform ink jet imaging has also improved several times.

One limitation of this process has been present since the use of ink jet imaging first began. This limitation concerns the inability to successfully image with ink jet ink onto areas of a substrate having a heavy coverage of press ink. The ink jet ink, which is typically aqueous based, and the press ink, which is typically organic based, are incompatible in part because of a difference in surface tension between the two. This difference in surface tension generally causes ink jet ink to bead up on the surface of areas of a printed article having a heavy coverage of press ink when the ink jet ink is applied directly to the layer of press ink. This beading of the ink jet ink provides the article with an unsightly mottled appearance. Further, once the ink jet ink beads up on the surface of the press ink, the ink jet ink easily smears and/or wipes off of the printed article rendering the article useless. This limitation particularly affects industries which mass produce printed articles such as personalized forms, mailers, bar coded addresses, advertisements and other similar articles.

It is common in the art either to "reverse out" (i.e. leave unprinted) areas which are to be ink jet imaged or to not print valuable information, such as name and address, on any areas of a substrate which have areas of heavy coverage of press ink. Currently in the art, it is possible to ink jet image on areas of press ink coverage but such imaging is limited to areas having a maximum press ink print density of a 30% screen. An area of press ink coverage of a 30% screen has a pale pastel-like appearance which is undesirable for most printed articles. Any higher print density of press ink results in the ink jet ink easily smearing and, often, running off of the printed article. To ensure proper application of ink jet ink to an article which will have areas which are covered with press ink, the areas which are to be ink jet imaged will preferably receive no coverage of press ink.

Additionally, a heavy basis weight paper, such as 60 lb./ream offset paper, is required for ink jet imaging. When an offset paper having a basis weight less than 60 lb./ream is used, the ink jet ink penetrates the paper and shows through to the opposite side of the paper from the printed side. This results in the production of an unattractive and often useless printed article, especially if the article is to be ink jet imaged on both sides of the paper. Because one factor considered when purchasing paper is its price per basis weight, the use of high basis weight paper for a printed article increases the price of the final printed article.

For these reasons, a need has developed in the art for a method of imaging with ink jet ink on areas having heavy press ink coverage and a printed article which includes ink jet imaging on heavy press ink coverage areas. A need has also developed for a method of ink jet imaging on lower basis weight paper to decrease the price of a printed article.

SUMMARY OF THE INVENTION

This invention meets those needs by providing a method of printing and imaging which enables ink jet imaging onto areas having press ink density of up to a 60% screen and, in a preferred embodiment, onto areas having press ink density of up to or equal to a 100% screen. This method particularly relates to variable information ink jet printing, i.e. imaging, used to produce custom printed articles such as personalized forms, advertisements, mailers and other similar custom printed articles. This method also permits the use of lower basis weight papers than are conventionally used, which decreases the price of the final printed article. The invention is also directed to a printed article which incorporates the above indicated features of the method.

It has been discovered that, with proper control of the surface energy of the press ink and the surface tension of the ink jet ink, an article which has a press ink coverage of greater than 30% screen can be successfully imaged with ink jet ink to provide substantially uniform coverage of ink jet ink in the imaged areas. To be useful with this invention, the various inks and coatings on the article must be compatible with each other in some manner. By "compatible" it is meant that the surface energy or surface tension of one layer on the article and the surface tension or surface energy of a second layer on the article differ by a small enough margin to allow one layer to wet the surface of the other layer and to be retained on the surface of the substrate on which the printed article is printed. In most instances, as that difference exceeds 6 dynes/cm, the quality of the final printed article declines. To increase the compatibility of a solvent-based press ink and the water-based ink jet ink, the surface energy of the solvent-based press ink can be increased by formulating the solvent-based press ink to be relatively wax-free and/or to have a higher solids content.

In one embodiment of this invention, a press ink having an increased surface energy is applied to a substrate. Next, an image formed by an ink jet ink having a low surface tension is applied to the layer of press ink. The ink jet ink is chosen so that its surface tension is compatible with the surface tension of the press ink. Typically, a conventional aqueous-based ink jet ink has a surface tension of between about 45 dynes/cm to about 75 dynes/cm. For this embodiment, an ink jet ink having a surface tension as close as possible to about 30 dynes/cm is employed without having to resort to a specially formulated ink jet ink. Preferably, the ink jet ink will have a surface tension of about 30 dynes/cm to about 40 dynes/cm.

The press ink is used to produce a surface to which the ink jet ink will adhere. The press ink can be either a solvent-based ink formulated to be wax-free and have a higher solids content or an aqueous-based flexographic ink. Preferably, the solvent-based ink or the aqueous-based ink, whichever is used, will have a surface tension of between about 30 to about 45 dynes/cm. This smaller difference in surface tension between the press ink and the ink jet ink allows the ink jet ink to wet the surface of the press ink layer and to be retained on the surface of the substrate. Because the surface tensions of these two layers are compatible, the ink jet ink will not penetrate through the substrate. Preferably, in this embodiment, to be compatible with the press ink, the surface tension of the ink jet ink should not differ by more than about 5 dynes/cm from the surface energy of the layer of press ink.

In a preferred embodiment, to provide an interface between the layer of press ink and the ink jet ink, a compatibilizing liquid, which has a surface tension which is compatible with both the surface energy of the press ink and the surface tension of the ink jet ink, is applied to the layer of press ink. The compatibilizing liquid can be either a coating or varnish depending upon the method by which it is applied to the substrate.

In this preferred embodiment, the solvent-based press ink is wax-free but does not have to have a higher solids content. The surface tension of the compatibilizing liquid bridges the gap between the surface energy of the press ink and the surface tension of the ink jet ink to make the ink jet ink compatible with the press ink so that the ink jet ink can wet the layer of press ink and be retained on the surface of the substrate. The differences in the individual surface tensions between the layers results in a useful combination of substrate, press ink, compatibilizing liquid and image. This embodiment allows more press and ink jet inks to be used with this invention than are used in the embodiment described above by allowing lower surface energy press inks and higher surface tension ink jet inks to be used.

When the compatibilizing liquid is employed, a layer of press ink is applied to a substrate. After the layer of press ink has been applied to the substrate, a layer of the compatibilizing liquid is applied to the press ink layer. The layer of compatibilizing liquid provides a substrate to which ink jet ink can be applied and to which ink jet ink will adhere. Once the compatibilizing liquid has been applied, an ink jet image is applied to the surface of the layer of press ink. To make the surface energy of the press ink compatible with the surface tension of the ink jet ink, the compatibilizing liquid preferably has a surface tension which is no more than about 5 dynes/cm greater than the surface energy of the layer of press ink and no more than about 5 dynes/cm less than the surface tension of the ink jet ink. More preferably, the difference in surface tensions between each of the layers is no more than about 3 dynes/cm. With this embodiment, ink jet imaging can be performed on areas having a press ink density of up to about a 60% screen.

In a more preferred embodiment, a solvent-based wax-free press ink, which is formulated to be essentially free of volatile organic components and which has a higher solids content, is printed onto a substrate to create a layer of press ink having an area of press ink coverage. Again, a compatibilizing liquid, having the same surface tension requirements as described above, is applied to the article. After the compatibilizing liquid is applied, an ink jet ink image is applied to the surface of the layer of press ink. When a wax-free solvent-based press ink having a higher solids content is used, the method can be used to apply an ink jet image to articles having a print density of press ink of up to or equal to about a 100% screen.

The methods of this invention enhance the process of ink jet printing on areas having heavy coverage of press ink. Specifically, this invention provides a method for increasing the quality of ink jet imaging on articles with heavy coverage of press ink. This invention also eliminates the need to reverse out areas to be ink jet imaged on heavy ink coverage forms. Additionally, by making the layer of ink jet ink compatible with the layer of press ink, the ink jet ink is prevented from penetrating through the substrate allowing the use of papers having a basis weight lower than 60 pound per ream offset paper. The use of lower basis weight papers reduces the per unit cost of printed articles. Because a higher coverage of press ink can be applied to the printed article, an article having a brighter color image can be produced. Printed articles having brighter color images are in great demand by those businesses competing in the color imaging marketplace.

DETAILED DESCRIPTION OF THE PREFERRED EMBODIMENTS

Standard solvent-based press inks are formulated to include waxes, silicones, oils and other materials which impart a low surface energy to the layer of press ink once it has been applied to a substrate. Typically, a conventional press ink is a solvent-based flexographic ink which is prepared by dispersing pigments in an organic solvent, such as an alcohol, ketone or hydrocarbon, whereas an ink jet ink is typically aqueous based. Although the press ink is usually formed from an ink having an 80% solids content, the surface energy of such a press ink is approximately 20 dynes/cm. On the other hand, the surface tension of a typical aqueous-based ink jet ink droplet as it leaves the orifice of an ink jet is approximately 65 dynes/cm. The difference between the surface tension of the ink jet ink and the surface energy of the press ink inhibits ink jet printing on a substrate covered with a standard press ink, particularly on substrates having press ink coverage of greater than a 30% screen, by preventing the ink jet ink from wetting the layer of press ink and being retained on the surface of the substrate.

Figure 1:
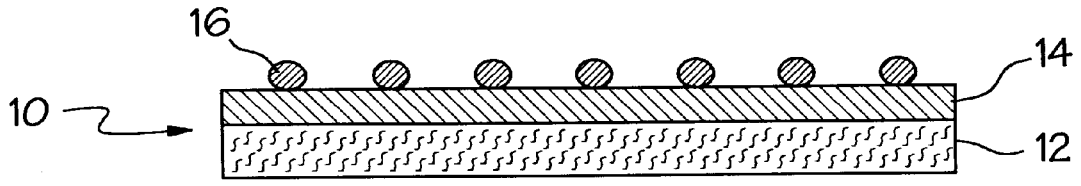
FIG. 1 shows a cross-sectional view of a conventional article which has been imaged with ink jet ink.

FIG. 1 shows a cross-sectional view of a conventional printed article which has been imaged with ink jet ink. The printed article 10 includes a substrate 12, a layer of press ink 14 and a "layer" of ink jet ink 16. This figure illustrates how the ink jet ink 16 beads up on the surface of the layer 14 of conventional press ink. The incompatibility of the surface energy of the layer 14 of press ink and the surface tension of the layer 16 of ink jet ink causes the ink jet ink to remain in a beaded condition. When the ink jet ink 16 beads up, it yields a mottled appearance and is easily smeared and removed from the surface of the printed article 10.

It has been discovered that ink jet ink can be imaged on areas of printed articles having a heavy coverage of press ink by controlling the difference between the surface energy of a layer of press ink and the surface tension of a layer of ink jet ink so that the two layers are compatible. As stated above, "compatible" means that the difference between the surface energy or surface tension of one layer on the article and the surface tension or surface energy of a second layer on the article differ by a small enough margin to allow one layer to wet the surface of the other layer and to be retained on the surface of the substrate. In a preferred embodiment of this invention, a compatibilizing liquid is applied over the press ink to provide a surface which more closely matches the surface tension of the ink jet ink to allow the use of a wider variety of ink jet and press inks. Using this method, the ink jet ink can be imaged over an area of press ink coverage of up to a 60% screen. In a more preferred embodiment, a wax-free press ink having a higher solids content is used. With this more preferred embodiment, the ink jet ink can be imaged over an area of press ink density of a 100% screen.

Figure 2:
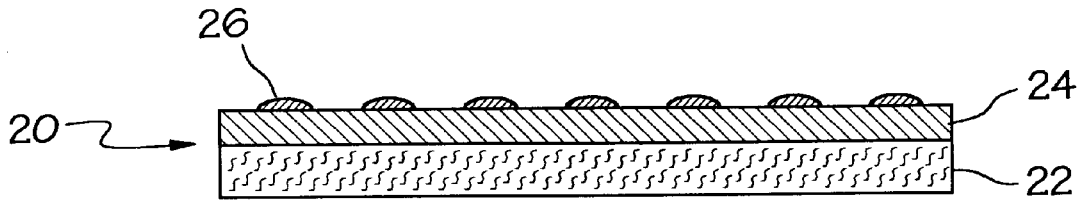
FIG. 2 shows a cross-sectional view of an article printed by the method of this invention.

FIG. 2 shows a cross-sectional view of one embodiment of this invention. In FIG. 2, the printed article 20 comprises a substrate 22, a layer 24 of press ink and an image 26 formed by ink jet ink. It has been discovered that the printed article 20 can be successfully imaged with proper control of the surface tensions of the ink jet ink and the press ink. The layer 24 of press ink can be either a relatively wax-free higher solids solvent-based ink, as described below, or an aqueous-based flexographic ink. The water-based flexographic ink will have a surface energy of about 50 to about 55 dynes/cm. If a solvent-based ink is used, it must be specially formulated to make it compatible with the ink jet ink.

In this embodiment, a layer 24 of press ink is first applied to the surface of substrate 22. Layer 24 is then dried before the application of image 26. Once image 26 has been applied, it is dried and article 20 is ready for use or shipment. Preferably, the surface tension of the ink jet ink will be no more than about 5 dynes/cm greater than the surface energy of the press ink.

In order to make the solvent-based press ink more compatible with the ink jet ink, the formulation of the solvent-based press ink is altered. To allow ink jet imaging on areas of a substrate having heavy coverage of solvent-based press ink, the solvent-based press ink must be formulated to have a higher solids content than a conventional press ink. Further, to be compatible with the ink jet ink, the solvent-based press ink should be essentially free of volatile organic components and such items as waxes and oils, and silicone. By "essentially free," it is meant that the content of volatile organic components and silicone does not exceed about 10% of the total volume of the ink. In other words, the solids content of the solvent-based press ink is at least about 90% by volume. For that reason, these inks are referred to as "higher solids" inks. The reduction of volatile organic components and surfactants from the solvent-based press ink raises its surface energy from the low to mid 20 dynes/cm to a level above 30 dynes/cm. The combination of a higher solids content and being wax-free further raises the surface tension of the solvent-based press ink to between about 35 dynes/cm to about 45 dynes/cm. Such a wax-free higher solids solvent-based press ink is available from Continental Ink of Columbus, Ohio under the product designation "4-UV-Kote".

The ink jet ink, which is used to form image 26, is selected on the basis of its surface tension which is preferably as close as possible to about 40 dynes/cm. Typically, a conventional ink jet ink has a surface tension of between about 30 dynes/cm to about 75 dynes/cm. For this embodiment, an ink jet ink having a surface tension as close as possible to 40 dynes/cm is chosen. Preferably, the ink jet ink will have a surface tension of about 38 dynes/cm to about 43 dynes/cm. The compatibility of the surface tension of the image 26 with the surface energy of the layer 24 of press ink allows the ink jet ink to wet the surface of the layer 24 of press ink so that the ink jet ink is retained on the surface of the substrate. However, this method may not be optimal for all end uses because wax-free higher solids press inks are considered to be nondrying. For that reason, the inks used to formulate the printed article may occasionally experience offset and rub off problems.

Figure 3:
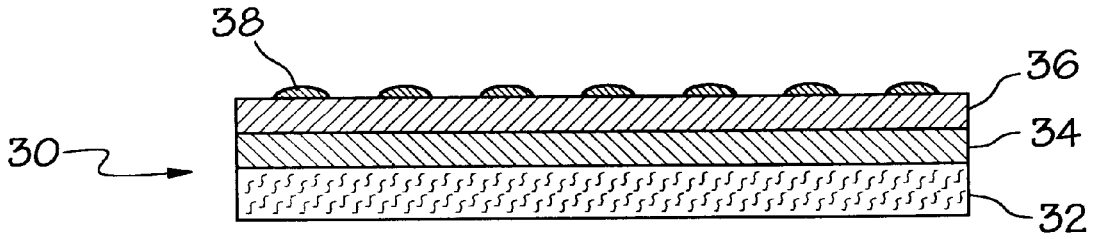
FIG. 3 shows a cross-sectional view of an alternate embodiment of this invention.

FIG. 3 presents a cross-sectional view of a preferred embodiment of this invention. As shown in FIG. 3, the printed article 30 comprises a substrate 32, a layer 34 of press ink, a layer 36 of compatibilizing liquid, and an image 38 formed by ink jet ink. The layer 34 of press ink is first applied to the substrate 32 in the manner described below. As described above, the layer 34 of press ink can be either a water-based flexographic ink or a wax-free solvent-based ink. With this embodiment, the solvent-based ink is formulated to be relatively wax-free but it does not have to have a higher solids content, as did the solvent-based press ink in the previous embodiment. Wax-free solvent-based inks typically have a surface energy of between about 30 dynes/cm to about 45 dynes/cm. A relatively wax-free solvent-based press ink which is useful with this invention is available from Continental Ink of Columbus, Ohio and a suitable water-based flexographic ink is available from Flint Inks of Ann Arbor, Mich.

Once layer 34 of press ink has been applied to the substrate 32, layer 36 of compatibilizing liquid is applied as a continuous film in a conventional manner over layer 34 of press ink. Layer 34 of press ink and layer 36 of compatibilizing liquid are then dried, as described below. After layer 36 of compatibilizing liquid has been applied, an image 38 is applied, using a conventional ink jet printer, to the surface of the layer 34 of press ink on the surface of printed article 30. For example, image 38 can be alphanumeric, graphic or personal indicia, such as a name and address of a recipient. The ink jet ink typically has a surface tension of about 30 dynes/cm to about 75 dynes/cm. After image 38 has been applied to the article, it is also dried, as described below.

This preferred embodiment is particularly useful when nondrying solvent-based press inks experience offset and/or rub off problems because layer 36 of compatibilizing liquid inhibits layer 34 of press ink from offsetting and/or rubbing off by providing a compatible interface between layer 34 of press ink and image 38. The addition of layer 36 of compatibilizing liquid allows ink jet imaging on areas of printed articles which have a print density of up to about a 60% screen.

In the embodiment shown in FIG. 3, layer 36 compatabilizes layer 34 of press ink with image 38 by having a surface tension which bridges the gap between the surface energy of the press ink and the surface tension of the ink jet ink. The compatibilizing liquid, which forms layer 36, will have a surface tension which is preferably no more than about 5 dynes/cm greater than the surface energy of the press ink and likewise has a surface tension which is preferably no more than about 5 dynes/cm less than the surface tension of the ink jet ink. Most preferably, the compatibilizing liquid will have a surface tension which is no greater than about 3 dynes/cm greater than the surface energy of the press ink and likewise has a surface tension which is no more than about 3 dynes/cm less than the surface tension of the ink jet ink.

As stated above, the compatibilizing liquid can be either a coating or a varnish. If the compatibilizing liquid is a varnish, then the varnish can be any conventional varnish as long as its surface tension conforms to the above guidelines. Preferably, the compatibilizing liquid is a varnish which is aqueous-based. Most preferably, the compatibilizing liquid is a glycol-based acrylic resin varnish which produces a high energy film of about 30 dynes/cm to about 40 dynes/cm. Useful glycols include diethylene glycol and dipropylene glycol. Such a glycol-based acrylic resin is available from Kustom Blending, Inc. of Florence, Ky. under the product designation "KS 125". Similarly, if the compatibilizing liquid is a coating, then the coating can be any conventional coating as long as its surface tension conforms to the above guidelines. Useful coatings include 6933 from Craig Adhesives of Newark, N.J. and 92W110 from Valspar Corp. of Minneapolis, Minn.

In a more preferred embodiment, a relatively wax-free and higher solids content solvent-based press ink is used as the press ink. As described above, this type of solvent-based press ink has a higher surface tension than a conventional solvent-based press ink and, thus, is more compatible with the ink jet ink. By using a wax-free higher solids content solvent-based ink which has a surface tension which more closely matches the surface tension of the ink jet ink than would a conventional solvent-based press ink, ink jet imaging can be performed on printed articles having a press ink density of up to or equal to a 100% screen.

The compatibilizing liquid for the more preferred embodiment is, as described above, an aqueous-based varnish and, preferably, a glycol based acrylic resin varnish. With the more preferred embodiment, as with the previously described embodiment, the compatibilizing liquid will have a surface tension which is preferably no greater than about 5 dynes/cm greater than the surface energy of the press ink and likewise has a surface tension which is preferably no more than about 5 dynes/cm less than the surface tension of the ink jet ink. Most preferably, the compatibilizing liquid will have a surface tension which is no greater than about 3 dynes/cm greater than the surface energy of the press ink and likewise has a surface tension which is no more than about 3 dynes/cm less than the surface tension of the ink jet ink.

Although the press ink has been described herein as being applied to the substrate in a "layer," one skilled in the art will appreciate that the press ink can cover any portion of the substrate and does not have to cover the entire surface of the substrate, although it may. The amount of coverage of press ink applied to the article is determined by the requirements for the final printed article.

In any of the above described embodiments, the press ink can be applied to the substrate using a standard web offset lithographic process. Other useful modes for applying the press ink to the substrate include letter press and dry offset methods. The press ink is typically applied to the substrate in a volume of one pound for every 200,000 to 1,000,000 square inches of substrate. In the embodiments described above, the press ink is preferably applied in a volume of approximately one pound per every 600,000 square inches of substrate. One skilled in the art will appreciate that the volume of press ink applied to the substrate also depends upon the sheet width of the substrate and the number of repeating elements to be printed.

As stated above, the compatibilizing liquid can be either a coating or a varnish. For any of the above embodiments which employ a varnish as a compatibilizing liquid, the varnish is typically applied to the substrate by dry offset printing. The compatibilizing liquid may also be applied by a flexographic application process, a letterpress process or by extrusion coating, if it is a coating. The amount of compatibilizing liquid applied to the layer of press ink depends upon what is being printed and the type of paper stock being used. Keeping that in mind, the compatibilizing liquid is typically applied in an amount of one pound per every 50,000 to 600,000 square inches of substrate. In the embodiments described, the compatibilizing liquid is preferably applied in a weight of one pound for every 200,000 square inches of substrate.

In any of the embodiments described above, the press ink and compatibilizing liquid, if applied, are dried before the application of the ink jet ink. Usually, the substrate is passed through an oven in which the press ink and compatibilizing liquid are dried. The oven is kept at a temperature of approximately 200° F. or hotter depending on the line speed of the process. In no case does the drying temperature exceed approximately 350° F. The press ink and compatibilizing liquid may also be dried by infrared heat or a radiant heat process.

The ink jet ink is applied to the substrate by means of an ink jet printer and preferably by means of a Scitex Model 3600 ink jet printer available from Scitex of Dayton, Ohio. The amount of ink jet ink applied to the substrate depends upon the type of ink jet printer being used, the drop size, the desired shade of ink on the substrate, and, most importantly, what is being printed on the substrate. Useful ink jet inks for any of the above embodiments are available from the following: Scitex in Dayton, Ohio under the product designations "3600" and "5100"; and U.S. Ink of Chicago, Ill. under the product designation "BC-45". Once the ink jet ink has been applied to the substrate, it too is dried in an oven at the temperatures described above. The ink jet ink may also be dried by infrared heat or radiant heat.

Additionally, an adhesive can be applied to the substrate on the side opposite the printing without limiting the effectiveness of this invention. Such an adhesive is used to secure the substrate to the surface of another article such as, for example, a magazine cover or page. Useful adhesives include hot melt adhesives, water-based acrylic adhesives, dextrin glues and dextrin resin blends. Preferably, a hot melt or water-based acrylic adhesive is used.

The method of this invention has been shown to be effective on a variety of paper stocks and basis weights. Useful paper stocks include offset, label, papeterie, matte, coated two sides and index. The useful paper stocks can be either coated or uncoated. Various basis weight papers can be used as a substrate for the printed article of this invention. Previously in the art, ink jet imaging had to be performed on at least 60 lb./ream offset paper or its equivalent because ink jet ink will penetrate lower basis weight offset papers and show through on the back side of such paper if nothing exists to hold it on the surface of the paper. With the method of this invention, a lower basis weight paper can be used because the ink jet ink is held on the top surface of the substrate by a cohesive interaction with the press ink and/or the coating layer. Offset papers having basis weights less than or equal to about 50 lb./ream can be used with the method of this invention. In fact, offset papers having basis weights as low as about 40 lb./ream have been shown to be effective with the method of this invention. One skilled in the art will also appreciate that papers, other than offset paper, having basis weights equivalent to those above may also be used. By providing a method which allows the use of lower basis weight papers, the cost of producing printed articles, such as personalized forms, mailers, advertisements and other similar articles, can be greatly reduced.

The following examples are intended to illustrate the invention and not to be of limiting nature.

EXAMPLE 1

A 60 pound/ream white offset paper was printed with standard heatset offset inks on a heatset web offset printing press. A pattern, which consisted of four color bars (magenta, cyan, yellow and fluorescent orange), each four inches long, was printed onto the paper web. Each color bar was made up of 1.5 inch wide solid ink screens ranging from 10% on one side of the sheet to 100% on the other side of the sheet. The screens were printed in 10% increments.

In a fifth printing tower, an overprint varnish (KS-125) was applied as a compatibilizing liquid over the entire sheet by means of a dry offset printing process.

Immediately after being printed, the sheet was passed through a gas fired hot air oven to set the inks. The paper web was then wound onto a roll.

The roll of printed paper was then ink jet imaged on a Scitex 3600 ink jet printer using black Scitex 3600 ink jet ink. The image pattern was examined and the printing was found to be somewhat receptive of ink jet ink up to the 60% screen density. The same paper printed in the same manner without the overprint varnish was found to have acceptable ink jet imaging up to a 30% screen density.

EXAMPLE 2

A 60 pound/ream white offset paper was printed with the 4-UV-Kote ink, available from Continental Ink, on a heatset web offset printing press. A pattern, which consisted of four color bars (magenta, cyan, yellow and fluorescent orange), each four inches long, was printed onto the paper web. Each color bar was made up of 1.5 inch wide solid ink screens ranging from 10% on one side of the sheet to 100% on the other side of the sheet. The screens were printed in 10% increments.

In a fifth printing tower, an overprint varnish (KS-125) was applied as a compatibilizing liquid over the entire sheet by means of a dry offset printing process.

Immediately after being printed, the sheet was passed through a gas fired hot air oven to set the inks. The paper web was then wound onto a roll.

The roll of printed paper was then ink jet imaged on a Scitex 3600 ink jet printer using black Scitex 3600 ink jet ink. The image pattern was examined and the printing was found to be receptive of ink jet ink up to the 100% screen density. The same paper printed in the same manner without the overprint varnish was found to have acceptable ink jet imaging up to a 60% screen density.

EXAMPLE 3

A 70 pound/ream white matte paper was printed with standard heatset offset inks on a heatset web offset printing press. A pattern, which consisted of four color bars (magenta, cyan, yellow and fluorescent orange), each four inches long, was printed onto the paper web. Each color bar was made up of 1.5 inch wide solid ink screens ranging from 10% on one side of the sheet to 100% on the other side of the sheet. The screens were printed in 10% increments.

In a fifth printing tower, an overprint varnish (KS-125) was applied as a compatibilizing liquid over the entire sheet by means of a dry offset printing process.

Immediately after being printed, the sheet was passed through a gas fired hot air oven to set the inks. The paper web was then wound onto a roll.

The roll of printed paper was then ink jet imaged on a Scitex 3600 ink jet printer using black Scitex 3600 ink jet ink. The image pattern was examined and the printing was found to be somewhat receptive of ink jet ink up to the 60% screen density. The same paper printed in the same manner without the overprint varnish was found to have acceptable ink jet imaging up to a 20% screen density.

EXAMPLE 4

A 70 pound/ream white matte paper was printed with the 4-UV-Kote ink, available from Continental Ink, on a heatset web offset printing press. A pattern, which consisted of four color bars (magenta, cyan, yellow and fluorescent orange), each four inches long, was printed onto the paper web. Each color bar was made up of 1.5 inch wide solid ink screens ranging from 10% on one side of the sheet to 100% on the other side of the sheet. The screens were printed in 10% increments.

In a fifth printing tower, an overprint varnish (KS-125) was applied as a compatibilizing liquid over the entire sheet by means of a dry offset printing process.

Immediately after being printed, the sheet was passed through a gas fired hot air oven to set the inks. The paper web was then wound onto a roll.

The roll of printed paper was then ink jet imaged on a Scitex 3600 ink jet printer using black Scitex 3600 ink jet ink. The image pattern was examined and the printing was found to be receptive of ink jet ink up to the 100% screen density. The same paper printed in the same manner without the overprint varnish was found to have acceptable ink jet imaging up to a 60% screen density.

Although the invention has been described herein as being useful when the substrate is a paper stock, the method of this invention can also be used to apply an ink jet image to substrates selected from the group consisting of glass, metals, paper and plastics.

One skilled in the art will appreciate that the invention is not limited to the precise methods and products described herein, and that changes can be made to the methods and products without departing from this scope of the invention, which is defined in the appended claims.

What is claimed is:

1. A printed article comprising:

a substrate;

a layer of press ink on the substrate, the layer of press ink having a print density of greater than a 30% screen and having a surface energy; and an image formed directly on the layer of press ink, the image being formed by ink jet ink which has a surface tension of from about 30 to about 40 dynes/cm that is compatible with the surface energy of the layer of press ink so that the ink jet ink can be retained on the surface of the substrate.

2. The printed article of claim 1 wherein the surface tension of the ink jet ink is no more than about 5 dynes/cm greater than the surface energy of the press ink.

3. The printed article of claim 2 wherein the press ink is solvent-based, has a solids content of greater than or equal to 90%, by volume, and is essentially free of wax.

4. The printed article of claim 2 wherein the press ink is a aqueous-based flexographic ink.

5. The printed article of claim 1 wherein the substrate is selected from the group consisting of offset paper stock, label paper stock, papeterie paper stock, matte paper stock, coated two side paper stock and index paper stock.

6. The printed article of claim 1 wherein the substrate is selected from the group consisting of glass, metal, paper and plastic.

7. A printed article comprising:

a substrate;

a layer of press ink on the substrate, the layer of press ink having a print density of greater than a 30% screen and having a surface energy;

an image, the image being formed by an ink jet ink which has a surface tension; and a compatibilizing layer on the layer of press ink and on which the image is formed, the compatibilizing layer consisting of a glycol based acrylic resin, the surface tension of said compatibilizing layer being compatible with both the surface energy of the press ink and the surface tension of the ink jet ink such that the ink jet ink can be retained on the substrate.

8. The printed article of claim 7 wherein the compatibilizing liquid has a surface tension which is no more than about 5 dynes/cm greater than the surface energy of the press ink and which is no more than about 5 dynes/cm less than the surface tension of the ink jet ink.

9. The printed article of claim 8 wherein the compatibilizing liquid has a surface tension which is no more than about 3 dynes/cm greater than the surface energy of the press ink and no more than about 3 dynes/cm less than the surface tension of the ink jet ink.

10. The printed article of claim 7 wherein the press ink is solvent-based, is essentially free of wax, and has an increased solids content of greater than 90%, by volume.

11. The printed article of claim 10 wherein the compatibilizing liquid has a surface tension which is no more than about 3 dynes/cm greater than the surface energy of the press ink and no more than about 3 dynes/cm less than the surface tension of the ink jet ink.

12. The printed article of claim 10 wherein the layer of press ink has a print density of a up to or equal to a 100% screen.

13. The printed article of claim 7 wherein the press ink is a water-based flexographic ink.

14. The printed article of claim 7 wherein the substrate is an offset paper having a basis weight less than about 60 lb./ream.

15. The printed article of claim 14 wherein the substrate is an offset paper having a basis weight less than or equal to about 50 lb./ream.

16. The printed article of claim 7 wherein the substrate is selected from the group consisting of offset paper stock, label paper stock, papeterie paper stock, matte paper stock, coated two side paper stock and index paper stock.

* * * * *